US005935917A

United States Patent [19]

Farrell et al.

[11] Patent Number: 5,935,917

[45] **Date of Patent: *Aug. 10, 1999**

[54] BAR COMPOSITION COMPRISING ENTRAPPED EMOLLIENT DROPLETS DISPERSED THEREIN

[75] Inventors: Terrence Farrell, West New York; Georgia Shafer, Carteret; James Dalton, Cliffside Park; Mengtao He, Wayne; Gregory McFann, East Rutherford, all of N.J.

[73] Assignee: Lever Brothers Company, New York, N.Y.

[ * ] Notice: This patent is subject to a terminal disclaimer.

[21] Appl. No.: 08/964,617

[22] Filed: Nov. 5, 1997

Related U.S. Application Data

[63] Continuation-in-part of application No. 08/828,442, Mar. 28, 1997, and application No. 08/670,887, Jun. 26, 1996, Pat. No. 5,783,536.

[51] Int. Cl.[6] ..... C11D 3/20; C11D 9/36; C11D 17/00

[52] U.S. Cl. ..... 510/141; 510/152; 510/153; 510/155; 510/156; 510/440; 510/447; 510/451; 510/466; 510/474; 510/484; 510/486; 510/495; 510/504; 510/511

[58] Field of Search ..... 510/141, 152, 510/153, 155, 156, 440, 447, 451, 466, 474, 495, 484, 486, 504, 511

[56] References Cited

U.S. PATENT DOCUMENTS

| | | | |
|---|---|---|---|
| 2,714,093 | 7/1955 | Blumenthal | 510/447 |
| 3,761,418 | 9/1973 | Parran, Jr. . | |
| 3,814,698 | 6/1974 | Ferrara . | |
| 3,933,672 | 1/1976 | Bartolotta et al. . | |
| 4,540,567 | 9/1985 | Oneto et al. | 424/45 |
| 4,652,392 | 3/1987 | Baginski et al. . | |
| 4,673,525 | 6/1987 | Small et al. | 510/151 |
| 4,732,694 | 3/1988 | Gowland et al. . | |
| 4,788,006 | 11/1988 | Bolich, Jr. et al. . | |
| 4,810,413 | 3/1989 | Pancheri et al. . | |
| 4,820,447 | 4/1989 | Medcalf, Jr. et al. . | |
| 4,927,557 | 5/1990 | Revis et al. . | |
| 5,037,818 | 8/1991 | Sime . | |
| 5,096,608 | 3/1992 | Small et al. . | |
| 5,154,849 | 10/1992 | Visscher et al. . | |
| 5,260,051 | 11/1993 | Cho . | |
| 5,336,427 | 8/1994 | Bunczk et al. . | |
| 5,510,049 | 4/1996 | Connor et al. . | |
| 5,540,854 | 7/1996 | Fair et al. | 510/152 |
| 5,543,072 | 8/1996 | Fost et al. | 510/151 |
| 5,683,973 | 11/1997 | Post et al. | 510/152 |
| 5,770,556 | 6/1998 | Farrell et al. | 510/447 |
| 5,783,536 | 7/1998 | Farrell et al. | 510/141 |
| 5,792,739 | 8/1998 | He et al. | 510/422 |
| 5,795,852 | 8/1998 | He et al. | 510/151 |

FOREIGN PATENT DOCUMENTS

| | | |
|---|---|---|
| 0294206 | 12/1988 | European Pat. Off. . |
| 94/08444 | 5/1992 | WIPO . |
| 94/03151 | 2/1994 | WIPO . |
| 94/03152 | 2/1994 | WIPO . |
| 94/17172 | 8/1994 | WIPO . |
| 96/28140 | 9/1996 | WIPO . |

*Primary Examiner*—Lorna Douyon
*Attorney, Agent, or Firm*—Ronald A. Koatz

[57] ABSTRACT

Novel chip compositions comprise specifically defined carriers; benefit agent; and thickening agent (e.g., fumed silica). Use of chips comprising excess of these carriers over benefit agent and thickening agent has been found to allow significant deposition of benefit agent without compromising processing. In a second embodiment, the invention comprises bar compositions comprising mixtures of the chips of the invention and chips containing defined surfactant systems. A process for forming the chips of the invention and a method of enhancing deposition without compromising processing using the chips of the invention are also disclosed.

14 Claims, No Drawings

BAR COMPOSITION COMPRISING ENTRAPPED EMOLLIENT DROPLETS DISPERSED THEREIN

RELATED APPLICATIONS

The present application is a Continuation-in-Part of Ser. No. 08/828,442, filed Mar. 28, 1997 which in turn is a Continuation-in-Part of Ser. No. 08/670,887, filed Jun. 26, 1996, now U.S. Pat. No. 5,783,536.

FIELD OF THE INVENTION

The present invention relates to bar compositions, particularly synthetic soap bar compositions, able to deliver beneficial agents (e.g., silicone, petrolatum, maleated soybean oil) in higher amounts than previously possible. In particular, the invention relates to bar compositions comprising emollient droplets entrapped in a thickened carrier. The emollient containing thickened carrier compositions are formed as separate chip/powder compositions and are then mixed with "base" chips (comprising the surfactant system) prior to milling, extruding and stamping the bars. The invention further relates to a method of making the additives. The invention further relates to a method of enhancing delivery of benefit agent from bars which method comprises mixing the base chips with the benefit agent containing chips, milling, extruding and stamping.

BACKGROUND OF THE INVENTION

It has long been a desirable goal to deliver some kind of benefit agent (e.g., silicone or other oils) to the skin through a personal wash composition.

In liquid cleansers, for example, cationic hydrophilic polymers such as Polymer JR® from Amerchol or Jaguar® from Rhone Poulenc have been used to enhance delivery of benefit agents (EP 93,602; WO 94/03152; and WO 94/03151). In applicants' copending application, U.S. Ser. No. 08/412,803 to Tsaur et al., now abandoned, separate hydrogel particles act as a structure to entrap the benefit agent in concentrated form.

In the subject invention, entrapment of benefit agent is achieved by producing compositions comprising emollient wherein the medium in which the emollients are found (e.g., hydrophobically modified polyalkylene glycols; polyoxyethylene-polyoxypropylene copolymers; or mixture of either or both with polyalkylene glycols) is thickened with a thickening agent (e.g., fumed silica) so that the droplets are entrapped in said medium. More specifically, and without wishing to be bound by theory, the above-identified compounds are believed to act as a matrix entrapping the emollient, and the thickener is believed to stop emollient from escaping from the matrix. In addition, mixing hydrophobically modified polyalkylene glycol (PAGs) or EO-PO copolymers with polyalkylene glycol can fine-tune the dissolution rate of adjuvant compounds used to make the bar so that they dissolve at same rate as surfactant chips also used in making the bar.

The emollient-containing thickened carrier compositions may be inserted into bars in concentrated forms (as in applicants' copending application Ser. No. 08/828,443 to Rattinger et al.) or dispersed throughout the bar. The thickened carrier composition should be prepared separate from the base bar composition and the separate chip compositions should be coextruded).

Delivery of benefit agents (e.g., silicone, maleated soybean oil) in bar compositions has proven more difficult in bars for a number of reasons. If the benefit agent is added homogeneously (i.e., is intimately mixed with other components), for example, the generally hydrophobic benefit agent is in intimate contact with hydrophobic materials in the base composition and is not "available" for deposition. Thus, little or no benefit agent will be present in the final bar (after milling, plodding and extrusion of chips) to be delivered to the skin. If the benefit agent is too viscous, on the other hand, it tends to get in the processing equipment and become too difficult to process.

U.S. Pat. No. 5,154,849 to Visscher et al. teaches bar compositions containing a silicone skin mildness/moisturizing aid component. In one embodiment, the silicone component may be mixed with a carrier which is selected to facilitate incorporation of the silicone. Preferred carrier is said to be polyethylene glycol. At column 16, the reference describes that silicone is mixed into melted Carbowax (polyethylene glycol), that the mixture is cooled to form flakes, and that the flakes are preferably added to an amalgamator.

It is clear, however, that the Visscher et al. reference contemplates a silicone/carrier system different from the benefit agent/carrier/thickener system of the subject invention. First, the Visscher patent does not teach thickener (e.g., fumed silica or water soluble starch), a critical component of the emollient containing compositions and one which is believed to provide the structure required to retain and engulf the benefit agent (e.g., silicone or other benefit agents) in the carrier. Second, as suggested above, the structure of the carrier/silicone chip is distinct. The Visscher et al. composition does not contain the silicone in discrete droplets, but rather the silicone oozes and surrounds the carrier. By contrast, the benefit agent droplets of the invention are discrete droplets retained within the chip. This helps to ensure the silicone benefit agent does not ooze and interfere with processing.

The discrete particles of the invention, in turn, are present for two reasons, it is believed. The first, as noted above, is presence of thickening agent (e.g. water soluble starch or fumed silica) which, while not wishing to be bound by theory, it is believed helps to thicken the carrier (e.g., hydrophobically modified polyalkylene glycol; EO-PO copolymers; mixtures of one or both with polyalkylene glycol) such that the viscosity of the carrier is minimum 800 centipoise (cps), preferably greater than 1500 cps, more preferably greater than 3000 cps and can thereby entrap the benefit agent. The second reason is that, unlike the Visscher et al. system, the present invention requires there be an equal amount or more of carrier relative to the benefit agent. By contrast, it appears from Visscher et al., where eleven pounds of silicone (column 15, lines 1–2), are mixed with 5 to 6 pounds of Carbowax (column 15, line 29) that there is probably an excess of silicone to PEG and, at the least, there is no recognition of the criticality of having an equal amount or more of carrier to benefit agent.

In short, the chips of the Visscher reference are extremely difficult to process both because there is no control over the amount of silicone used and because there is no use of thickened carrier.

Finally, Visscher teaches polyalkylene glycol carrier, but does not teach or suggest use of hydrophobically modified polyalkylene glycols; EO-PO copolymers; or mixtures of one or both with polyalkylene glycols.

SUMMARY OF THE INVENTION

In one embodiment of the invention, applicants have unexpectedly found that, when specific additive composition are made containing an equal amount or greater of carrier (e.g., hydrophobically modified polyalkylene glycol; EO-PO copolymers; mixtures of one or both these groups with polyalkylene glycols) to benefit agent and further containing a thickening agent for said carrier such that the viscosity of carrier is 800 cps or greater, preferably greater than 1500 cps, more preferably greater than 3000 cps, the benefit agent (e.g., silicone, petrolatum, maleated soybean oil etc.) becomes entrapped as discrete droplets in the thickened carrier which in turn allows the benefit agent to be much more readily processed.

Specifically, in this embodiment the invention comprises a chip composition comprising:

(a) 40% to about 80% by wt. of the chip composition of a carrier selected from the group consisting of
  (1) hydrophobically modified polyalkylene glycol having MW of about 4,000–25,000 wherein the compound has formula $(AG)_m$—R or R—$(AG)_m$—R, AG being alkylene glycol monomer unit, m being greater than 50 and R being attached hydrophobic group;
  (2) a polyoxyethylene-polyoxypropylene nonionic copolymer having MW about 4000 to 25,000;
  (3) mixtures of (1) and (2); and
  (4) mixtures of (1) and/or (2) with polyalkylene glycol having a molecular weight greater than 4000, preferably greater than 5,000 to 20,000, more preferably 5000 to 10,000;

(b) 10% to 40% by wt. of the chip composition of benefit agent (e.g., silicone petrolatum, maleated soybean oil);

(c) 0.01% to 30% by wt. chip composition thickening agent;

(d) 0% to 10% by wt. chip composition, preferably 0% to 5% by wt. water; and (e) 0% to 15% by wt. chip composition structurant/filler selected from the group consisting of $C_8$ to $C_{24}$ fatty acid or ester, $C_8$ to $C_{24}$ alcohol or ether derivative. Preferably, it is a $C_8$ to $C_{24}$ straight chain, saturated fatty acid.

The invention comprises an extruded bar composition which is produced using about 5 to 50%, preferably 10 to 40%, more preferably 20 to 40% chips as described above and about 95% to 50% chips comprising about 5% to 95% by wt. of a surfactant system wherein the surfactant is selected from the group consisting of soap, anionic surfactant, nonionic surfactant, amphoteric surfactant, zwitterionic surfactant, cationic surfactant and mixtures thereof. The "soap and/or surfactant" chips additionally may comprise other components typically found in such chips such as, for example, minor amounts of fragrance, preservative (e.g., butylated hydroxy toluene) skin feel polymer (e.g., guar) etc. It may also contain free fatty acid and/or structurant/inert filler.

Although the surfactant system of the second chip may be a pure soap surfactant system, preferably the surfactant system comprises:

(a) a first synthetic surfactant which is an anionic surfactant; and (b) a second synthetic surfactant selected from the group consisting of a second anionic different from the first, a nonionic, an amphoteric and mixtures thereof.

A particularly preferred surfactant system comprises acyl isethionate as the first anionic and a sulfosuccinate or a betaine surfactant or mixtures of the two.

In a third embodiment of the invention, the invention comprises a method of making benefit agent containing chips comprising:

(a) 40% to 80% of a carrier selected from one of groups (a) (1)–(4) above;

(b) 10% to 40% benefit agent;

(c) 0.01% to 30% thickening agent;

(d) 0% to 10% water; and (e) 0% to 10% structurant/filler which can be a $C_8$ to $C_{24}$ fatty acid or ester derivative or $C_8$ to $C_{24}$ alcohol or ether derivative, wherein said method comprises mixing the ingredients at temperatures above the melting point of the carrier (i.e., above about 50° C.) for 1 to 60 minutes; cooling on a chill roll (at about 0° to 25° C.); and collecting.

DETAILED DESCRIPTION OF THE INVENTION

In one embodiment of the invention, the present invention relates to novel soap chip compositions (e.g., in the process for making bars, molten compositions are formed which are then cooled on what is commonly called a chill roll to form flakes or chips; these chips are subsequently refined and/or plodded to form billets which are stamped and cut to form final bars) which are readily processable in conventional soap machinery while still showing significant benefit agent deposition (i.e., comparable to deposition obtained in liquid body washes).

By carefully controlling the level of benefit agent (so that it cannot exceed the level of carrier) and by utilizing thickening agent, such as, for example, starches or fumed silica (while not wishing to be bound by theory, it is believed the thickening agent thickens the carrier such that the emollient is entrapped in the carrier), applicants have been able to provide discrete droplets of benefit agent so that the agent is unable to stick to the machinery and significantly inhibit processing. Further, the emollient/benefit agent more readily deposits from the bar.

The emollient is prepared in one chip/composition and, base bar is separately prepared, and chips are later mixed. This is described below.

SEPARATE CHIP COMPOSITION

CARRIER

The first component (carrier) of the emollient chip may be a hydrophobically modified polyalkylene glycol (HMPAG) having broad molecular weight 4,000 to 25,000, preferably 4,000 to 15,000.

Generally, the polymers will be selected from polyalkylene glycols chemically and terminally attached by hydrophobic moieties, wherein the hydrophobic moiety can be derivatives of linear or branched alkyl, aryl, alkylaryl, alkylene, acyl (e.g., having a carbon number of $C_2$ to $C_{60}$, preferably $C_8$ to $C_{40}$; fat and oil derivatives of alkylglyceryl, glyceryl, sorbitol, lanolin oil, coconut oil, jojoba oil, castor oil, almond oil, peanut oil, wheat germ oil, rice bran oil, linseed oil, apricot pits oil, walnuts, palm nuts, pistachio nuts, sesame seeds, rapeseed, cade oil, corn oil, peach pit oil, poppyseed oil, pine oil, soybean oil, avocado oil, sunflower seed oil, hazelnut oil, olive oil, grapeseed oil, and safflower oil, Shea butter, babassu oil, etc. These hydrophobically modified polyalkylene glycols are usually commercially available (see Table 1 for examples).

To ensure water solubility, it is preferred that the portion of alkylene oxide moiety per mole of HMPAG is between 60% wt. and 99% wt. (preferably 85% wt. to 97% wt.). In other words, the total content of the hydrophobic moiety is between 1% wt. and 40% wt. (preferably 3% wt. to 15% wt.) per mole of the defined HMPAG.

In general, the HMPAGs of the invention have the following formula:

$$(AG)_m—R \text{ or } R—(AG)_m—R,$$

where AG is the alkylene glycol monomer unit (generally ethylene or propylene glycol), and m is greater than 50. R is any of the hydrophobic moieties described above.

Specifically, examples of various hydrophobically modified polyalkylene glycols are set forth in Table 1 below where in $T_m$ (°C.) were obtained from literature from the corresponding chemical suppliers or measured by the inventors using a differential scanning calorimetry technique.

TABLE 1

Representative hydrophobically modified PEGs.

| Chemicals | Suppliers (Brands) | Comments |
|---|---|---|
| POE(m)—R solid. | Witco (Varonic Ll-420) | R = glyceryltallowate; m = 200; white |
| solid. | Seppic (Simusol 220Tm) | R = glycerylstearate; m = 200; white |
| solid. | Americhol (glucam E-200) | R = glucoside; m = 200; white water soluble; white solid |
| | Calgene Chemical (600-S) | Tm:52-62C; R = stearate; m = 150; Tm:52-62C |
| | Calgene Chemical (600-L) | R = laurate; m = 150 |
| R—POE(m)—R | Stepan (KESSCO PEG6000 distearate) | R = stearate; m - 174; Tm:54C; white solid |

(R = Hydrophobic moieties such as linear or branched alkyl chains (e.g., having carbon number of C4 to C40); derivatives of sorbitol, lanolin radical, coconut radical, jojoba acid radical, castor oil radical, etc.;
POE = Polyoxyethylene (e.g., $—(CH_2CH_2O)_mH$);
m = No. ethylene oxide monomer units; m>50).

As noted, melting temperature of the compounds is preferred to be about 25°–85°.

The carrier may also be a polyoxyethylene polyoxypropylene nonionic copolymer (EO-PO) copolymers EO-PO Polymer The polyoxyethylene polyoxypropylene nonionic copolymers (EO-PO copolymers) of the subject invention are generally commercially available polymers having a broad molecular weight range and EO/PO ratio and a melting temperature of from about 25° to 85° C., preferably 40° to 65° C.

Generally, the polymers will be selected from one of two classes of polymers, i.e., (1) $(EO)_m(PO)_n(EO)_m$ type copolymers or $(PO)_n(EO)_m(PO)_n$ type copolymers of defined m/n ratio and optional hydrophobic moieties (e.g., decyltetradecanol ether) attached to either EO or PO compounds (such products are commercially available for example, from BASF under the Trademark Pluronic® or Pluronic-R®, respectively); or (2) EO-PO polymers with amine constituents such as $N_2C_2H_4(PO)_{4n}(EO)_{4m}$ or $N_2C_2H_4(EO)_{4m}(PO)_{4n}$ with defined values of m and n and optional hydrophobic moieties attached to either EO or PO components (such products are commercially available, for example from BASF as Tetronic® and Tetronic-R®, respectively).

Specifically, examples of various Pluronic and Tetronic EO-PO polymers are set forth in Table 2 below wherein $T_m$ (°C.) and Ross Miles foam height data (measured at 0.1% and 50° C.) were digested from literature from BASF.

TABLE 2

| Polymer | | $T_m$(° C.) | Foam Heights (ml) | EO and PO Number m/n |
|---|---|---|---|---|
| Pluronic: | $(EO)_m—(PO)_n—(EO)_m$ | | | |
| | F38 | 48 | 35 | 46/16 |
| | F68 | 52 | 35 | 75/30 |
| | F77 | 48 | 47 | 52/35 |
| | F87 | 49 | 44 | 62/39 |
| | F88 | 54 | 48 | 97/39 |
| | F98 | 58 | 43 | 122/47 |
| | F108 | 57 | 41 | 128/54 |
| | F127 | 56 | 41 | 98/67 |
| Pluronic-R: | $(PO_n—(EO)_m—(PO)_n$ | | | |
| | 10R8 | 46 | 20 | 90/9 |
| | 17R8 | 53 | 2 | 155/15 |
| | 25R8 | 54 | 15 | 227/21 |
| Tetronic: | $N_2C_2H_4—(PO)_{4n}(EO)_{4m}$ | | | |
| | 707 | 46 | 60 | 35/12 |
| | 1107 | 51 | 50 | 64/20 |
| | 908 | 58 | 40 | 85/16 |
| | 1307 | 54 | 40 | 78/25 |
| | 1508 | 60 | 40 | 159/30 |
| Tetronic-R: | $N_2C_2H_4—(EO)_{4m}(PO)_{4n}$ | | | |
| | 90R8 | 47 | 0 | 90/17 |
| | 110R7 | 47 | 0 | 64/21 |
| | 150R8 | 53 | 0 | 12/29 |

In general, the molecular weight of the copolymers used ranges from 2,000 to 25,000 (preferably 3,000 to 10,000). The EO-terminated polymers (Pluronic and Tetronic) are preferred to the PO-terminated ones (Pluronic-R and Tetronic-R) for the advantages of mildness enhancement and lather generation. To ensure water solubility, we prefer that the portion of ethylene oxide moiety per mole is between 50% to 90% wt., more preferably 60–85% wt. In other words, 2m:n (for Pluronic) or m:n (for Tetronic) ranges from 1.32 to 11.9, preferably 2.0 to 7.5.

As noted, melting temperature of the compounds must be about 25°–85°, preferably 40° to 65° C., the latter being more favorable for processing (e.g., chips form more easily and logs plod more readily).

Finally, the carrier can be mixtures of hydrophobically modified PAG with EO-PO copolymers; mixtures of hydrophobically modified PAG with polyalkylene glycols; mixtures of EO-PO copolymers with polyalkylene glycol or mixtures of both HMPAG and EO-PO copolymers with polyalkylene glycol, wherein polyalkylene glycol is defined as having a MW greater than 4000 to about 100,000, preferably 4000 to 10,000. An especially preferred carrier is polyethylene glycol, for example, Carbowax PEG 8000® from Union Carbide.

One advantage of using mixtures of either or both of HMPAG and EO-PO copolymers with polyalkylene glycol is to fine-tune dissolution rate of said chip composition to be same as that of surfactant chips. This is important for bar user properties (e.g., in maintaining bar integrity during wash).

Finally, it should be noted that use of polyalkylene glycol alone is also contemplated as carrier for this invention (with any benefit agent and any thickener) and that this is disclosed in applicant's copending U.S. Ser. No. 08/828,442, parent of the subject application.

Benefit Agent

The benefit agent of the subject invention may be a single benefit agent component or it may be a benefit agent compound added via a carrier. Further the benefit agent composition may be a mixture of two or more compounds one or all of which may have a beneficial aspect. In addition, the benefit agent itself may act as a carrier for other components one may wish to add to the bar composition.

The benefit agent can be an "emollient oil" by which is meant a substance which softens the skin (stratum corneum) by increasing into water content and keeping it soft by retarding decrease of water content.

Preferred emollients include:

(a) silicone oils, gums and modifications thereof such as linear and cyclic polydimethylsiloxanes; amino, alkyl alkylaryl and aryl silicone oils;

(b) fats and oils including natural fats and oils such as jojoba, soybean (including maleated soybean oil), rice bran, avocado, almond, olive, sesame, persic, castor, coconut, mink oils; cacao fat; beef tallow, lard; hardened oils obtained by hydrogenating the aforementioned oils; and synthetic mono, di and triglycerides such as myristic acid glyceride and 2-ethylhexanoic acid glyceride;

(c) waxes such as carnauba, spermaceti, beeswax, lanolin and derivatives thereof;

(d) hydrophobic plant extracts;

(e) hydrocarbons such as liquid paraffins, vaseline, microcrystalline wax, ceresin, squalene, pristan and mineral oil;

(f) higher fatty acids such as lauric, myristic, palmitic, stearic, behenic, oleic, linoleic, linolenic, lanolic, isostearic and poly unsaturated fatty acids (PUFA);

(g) higher alcohols such as lauryl, cetyl, stearyl, oleyl, behenyl, cholesterol and 2-hexydecanol alcohol;

(h) esters such as cetyl octanoate, myristyl lactate, cetyl lactate, isopropyl myristate, myristyl myristate, isopropyl palmitate, isopropyl adipate, butyl stearate, decyl oleate, cholesterol isostearate, glycerol monostearate, glycerol distearate, glycerol tristearate, alkyl lactate, alkyl citrate and alkyl tartrate;

(i) essential oils such as mentha, jasmine, camphor, white cedar, bitter orange peel, ryu, turpentine, cinnamon, bergamot, citrus unshiu, calamus, pine, lavender, bay, clove, hiba, eucalyptus, lemon, starflower, thyme, peppermint, rose, sage, menthol, cineole, eugenol, citral, citronelle, borneol, linalool, geraniol, evening primrose, camphor, thymol, spirantol, penene, limonene and terpenoid oils;

(j) lipids such as cholesterol, ceramides, sucrose esters and pseudo-ceramides as described in European Patent Specification No. 556,957;

(k) vitamins such as vitamin A and E, and vitamin alkyl esters, including those vitamin C alkyl esters;

(l) sunscreens such as octyl methoxyl cinnamate (Parsol MCX) and butyl methoxy benzoylmethane (Parsol 1789);

(m) phospholipids; and (n) mixtures of any of the foregoing components.

A particularly preferred benefit agent is silicone, preferably silicones having viscosity greater than about 10,000 centipoise. The silicone may be a gum and/or it may be a mixture of silicones. One example is polydimethylsiloxane having viscosity of about 60,000 centistokes. Other preferred emollients include petrolatum, maleated soybean oil and sunflower seed oil.

The benefit agent generally comprises about 10% to 40%, preferably 20% to 40%, most preferably 25% to 40% by weight of the chip composition.

Thickening Agent

A criticality of the invention is the presence of a thickening agent which is believed required to thicken the viscosity of the carrier.

The thickening agent must thicken the carrier such that the thickened carrier has a viscosity of at least 800 centipoises (cps), preferably at least 1500 cps, most preferably greater than 3000 cps.

Examples of thickening agents which may be used include silicas and starches. Among the starches which may be used are water soluble starches such as maltodextrin or partially soluble starches such as potato or corn starch. By water soluble is meant that a 10% by wt. or greater solution of the starch in water will dissolve to form a clear or substantially clear solution (except for small amounts of insoluble residue which may impart a translucent haziness to otherwise clear solution).

A particularly prepared thickening agent is fumed silica. Fumed silica is generally produced by the hydrolysis of silicon tetrachloride vapor in a flame of hydrogen and oxygen. The process produces particles of from about 7 to 30 millimicrons.

The enormous surface area and chain forming abilities are believed to allow it to form three-dimensional networks, altering flowing properties i.e., cause thickening.

The thickening agent will generally comprise the 0.01 to 30% by wt. of the composition, preferably 5% to 20% by wt., most preferably 5% to 10% by wt. of the composition.

It should be noted when fumed silica is used, thickener should comprise no more than about 10%.

Other Components

Water comprises 0 to 10%, preferably 0% to 8% by wt., most preferably 0.1 to 5% by wt. of the chip composition. It is sometimes preferred to have little or no additional water (other than that inherently present in the compounds) in the chip mixture because this may sometimes cause processing difficulties.

In addition the chip composition may comprise 0% to 15%, preferably 2% to 10% fatty acid, i.e., $C_8$ to $C_{24}$ fatty acid. Generally, this is a straight chain, saturated fatty acid although this is not necessarily the case. The fatty acid helps to modify the wear rate of the emollient chip to better match that of the base soap.

The chip may also comprise a structuring aid and/or filler which can be fatty acid as described above or ester derivative; or a preferably straight and saturated $C_8$ to $C_{24}$ alcohol or ether derivative.

BASE BAR COMPOSITIONS

The invention comprises extruded bar compositions in which 5% to about 50%, preferably 10% to 40%, more preferably 20% to 40% of the chips used to make the final bars comprise the benefit agent additives (i.e. chips) described above and in which 95% to 50%, preferably 90% to 60%, most preferably 80% to 60% of the chips comprise chips which comprise the surfactant system defining the final bar.

Specifically, the surfactant system chips comprise about 5% to 90% by wt. of a surfactant system wherein the surfactant is selected from the group consisting of soap (pure soap surfactant systems are included), anionic surfactant, nonionic surfactant, amphoteric zwitterionic surfactant, cationic surfactant and mixtures thereof. These chips may additionally comprise other components typically found in final bar compositions, for example, minor amounts of fragrance, preservative, skin feel polymer etc.

Surfactant System

The term "soap" is used herein in its popular sense, i.e., the alkali metal or alkanol ammonium salts of aliphatic alkane- or alkene monocarboxylic acids. Sodium, potassium, mono-, di- and tri-ethanol ammonium cations, or combinations thereof, are suitable for purposes of this invention. In general, sodium soaps are used in the compositions of this invention, but from about 1% to about 25% of the soap may be potassium soaps. The soaps useful herein are the well known alkali metal salts of natural of synthetic aliphatic (alkanoic or alkenoic) acids having about 12 to 22 carbon atoms, preferably about 12 to about 18 carbon atoms. They may be described as alkali metal carboxylates of acrylic hydrocarbons having about 12 to about 22 carbon atoms.

Soaps having the fatty acid distribution of coconut oil may provide the lower end of the broad molecular weight range. Those soaps having the fatty acid distribution of peanut or rapeseed oil, or their hydrogenated derivatives, may provide the upper end of the broad molecular weight range.

It is preferred to use soaps having the fatty acid distribution of coconut oil or tallow, or mixtures thereof, since these are among the more readily available fats. The proportion of fatty acids having at least 12 carbon atoms in coconut oil soap is about 85%. This proportion will be greater when mixtures of coconut oil and fats such as tallow, palm oil, or non-tropical nut oils or fats are used, wherein the principle chain lengths are $C_{16}$ and higher. Preferred soap for use in the compositions of this invention has at least about 85% fatty acids having about 12 to 18 carbon atoms.

Coconut oil employed for the soap may be substituted in whole or in part by other "high-alluric" oils, that is, oils or fats wherein at least 50% of the total fatty acids are composed of lauric or myristic acids and mixtures thereof. These oils are generally exemplified by the tropical nut oils of the coconut oil class. For instance, they include: palm kernel oil, babassu oil, ouricuri oil, tucum oil, cohune nut oil, murumuru oil, jaboty kernel oil, khakan kernel oil, dika nut oil, and ucuhuba butter.

A preferred soap is a mixture of about 15% to about 20% coconut oil and about 80% to about 85% tallow. These mixtures contain about 95% fatty acids having about 12 to about 18 carbon atoms. The soap may be prepared from coconut oil, in which case the fatty acid content is about 85% of $C_{12}$–$C_{18}$ chain length.

The soaps may contain unsaturation in accordance with commercially acceptable standards. Excessive unsaturation is normally avoided.

Soaps may be made by the classic kettle boiling process or modern continuous soap manufacturing processes wherein natural fats and oils such as tallow or coconut oil or their equivalents are saponified with an alkali metal hydroxide using procedures well known to those skilled in the art. Alternatively, the soaps may be made by neutralizing fatty acids, such as lauric ($C_{12}$), myristic ($C_{14}$), palmitic ($C_{16}$), or stearic ($C_{18}$) acids with an alkali metal hydroxide or carbonate.

The anionic detergent active which may be used may be aliphatic sulfonates, such as a primary alkane (e.g., $C_8$–$C_{22}$) sulfonate, primary alkane (e.g., $C_8$–$C_{22}$) disulfonate, $C_8$–$C_{22}$ alkene sulfonate, $C_8$–$C_{22}$ hydroxyalkane sulfonate or alkyl glyceryl ether sulfonate (AGS); or aromatic sulfonates such as alkyl benzene sulfonate.

The anionic may also be an alkyl sulfate (e.g., $C_{12}$–$C_{18}$ alkyl sulfate) or alkyl ether sulfate (including alkyl glyceryl ether sulfates) among the alkyl ether sulfates are those having the formula:

$$RO(CH_2CH_2O)_nSO_3M$$

wherein R is an alkyl or alkenyl having 8 to 18 carbons, preferably 12 to 18 carbons, n has an average value of greater than 1.0, preferably greater than 3; and M is a solubilizing cation such as sodium, potassium, ammonium or substituted ammonium. Ammonium and sodium lauryl ether sulfates are preferred.

The anionic may also be alkyl sulfosuccinates (including mono- and dialkyl, e.g., $C_6$–$C_{22}$ sulfosuccinates); alkyl and acyl taurates, alkyl and acyl sarcosinates, sulfoacetates, $C_8$–$C_{22}$ alkyl phosphates and phosphates, alkyl phosphate esters and alkoxyl alkyl phosphate esters, acyl lactates, $C_8$–$C_{22}$ monoalkyl succinates and maleates, sulphoacetates, alkyl glucosides and acyl isethionates.

Sulfosuccinates may be monoalkyl sulfosuccinates having the formula:

$$R^4O_2CCH_2CH(SO_3M)CO_2M; \text{ and}$$

amide-MEA sulfosuccinates of the formula;

$$R^4CONHCH_2CH_2O_2CCH_2CH(SO_3M)CO_2M$$

wherein $R^4$ ranges from $C_8$–$C_{22}$ alkyl and M is a solubilizing cation.

Sarcosinates are generally indicated by the formula:

$$R'CON(CH_3)CH_2CO_2M,$$

wherein $R^1$ ranges from $C_8$–$C_{20}$ alkyl and M is a solubilizing cation.

Taurates are generally identified by formula:

$$R^2CONR^3CH_2CH_2SO_3M$$

wherein $R^2$ ranges from $C_8$–$C_{20}$ alkyl, $R^3$ ranges from $C_1$–$C_4$ alkyl and M is a solubilizing cation.

Particularly preferred are the $C_8$–$C_{18}$ acyl isethionates. These esters are prepared by reaction between alkali metal isethionate with mixed aliphatic fatty acids having from 6 to 18 carbon atoms and an iodine value of less than 20. At least 75% of the mixed fatty acids have from 12 to 18 carbon atoms and up to 25% have from 6 to 10 carbon atoms.

Acyl isethionates, when present, will generally range from about 10% to about 70% by weight of the total bar composition. Preferably, this component is present from about 30% to about 60%.

The acyl isethionate may be an alkoxylated isethionate such as is described in Ilardi et al., U.S. Pat. No. 5,393,466, hereby incorporated by reference. This compound has the general formula:

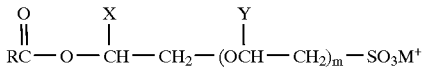

wherein R is an alkyl group having 8 to 18 carbons, m is an integer from 1 to 4, X and Y are hydrogen or an alkyl group having 1 to 4 carbons and $M^+$ is a monovalent cation such as, for example, sodium, potassium or ammonium.

Amphoteric detergents which may be used in this invention include at least one acid group. This may be a carboxylic or a sulphonic acid group. They include quaternary nitrogen and therefore are quaternary amido acids. They should generally include an alkyl or alkenyl group of 7 to 18 carbon atoms. They will usually comply with an overall structural formula:

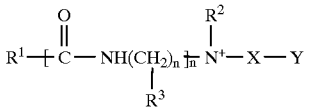

where $R^1$ is alkyl or alkenyl of 7 to 18 carbon atoms;

$R^2$ and $R^3$ are each independently alkyl, hydroxyalkyl or carboxyalkyl of 1 to 3 carbon atoms;

m is 2 to 4;

n is 0 to 1;

X is alkylene of 1 to 3 carbon atoms optionally substituted with hydroxyl, and

Y is $—CO_2—$ or $—SO_3—$

Suitable amphoteric detergents within the above general formula include simple betaines of formula:

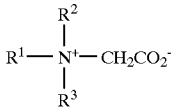

and amido betaines of formula:

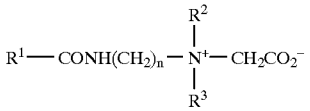

where n is 2 or 3.

In both formulae $R^1$, $R^2$ and $R^3$ are as defined previously. $R^1$ may in particular be a mixture of $C_{12}$ and $C_{14}$ alkyl groups derived from coconut so that at least half, preferably at least three quarters of the groups $R^1$ have 10 to 14 carbon atoms. $R^2$ and $R^3$ are preferably methyl.

A further possibility is that the amphoteric detergent is a sulphobetaine of formula:

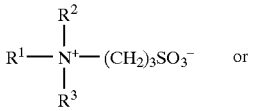

or

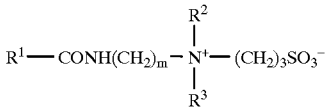

where m is 2 or 3, or variants of these in which $—(CH_2)_3SO_3^-$ is replaced by

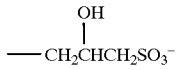

In these formulae $R^1$, $R^2$ and $R^3$ are as discussed previously.

The nonionic which may be used as the second component of the invention include in particular the reaction products of compounds having a hydrophobic group and a reactive hydrogen atom, for example aliphatic alcohols, acids, amides or alkylphenols with alkylene oxides, especially ethylene oxide either alone or with propylene oxide. Specific nonionic detergent compounds are alkyl ($C_6$–$C_{22}$) phenols ethylene oxide condensates, the condensation products of aliphatic ($C_8$–$C_{18}$) primary or secondary linear or branched alcohols with ethylene oxide, and products made by condensation of ethylene oxide with the reaction products of propylene oxide and ethylenediamine. Other so-called nonionic detergent compounds include long chain tertiary amine oxides, long chain tertiary phosphine oxides and dialkyl sulphoxides.

The nonionic may also be a sugar amide, such as a polysaccharide amide. Specifically, the surfactant may be one of the lactobionamides described in U.S. Pat. No. 5,389,279 to Au et al. which is hereby incorporated by reference or it may be one of the sugar amides described in U.S. Pat. No. 5,009,814 to Kelkenberg, hereby incorporated into the subject application by reference.

Examples of cationic detergents are the quaternary ammonium compounds such as alkyldimethylammonium halogenides.

Other surfactants which may be used are described in U.S. Pat. No. 3,723,325 to Parran Jr. and "Surface Active Agents and Detergents" (Vol. I & II) by Schwartz, Perry & Berch, both of which are also incorporated into the subject application by reference.

Although the bar may be a pure soap bar, preferably the surfactant system of this chip (forming the surfactant system in the bar) comprises:

(a) a first synthetic surfactant which is anionic; and (b) a second synthetic surfactant selected from the group consisting of a second anionic different from the first, a nonionic, an amphoteric and mixtures thereof.

The first anionic can be any of those recited above, but is preferably a $C_8$ to $C_{18}$ isethionate as discussed above. Preferably acyl isethionate will comprise 10% to 90% by wt. total bar composition.

The second surfactant is preferably a sulfosuccinate, a betaine or mixtures of the two. The second surfactant or mixture of surfactant will generally comprise 1% to 10% total bar composition. A particularly preferred composition comprises enough sulfosuccinate to form 3–8% total bar compositions and enough betaine to form 1–5% of total bar composition.

The base bar composition may also comprise water and structurant/filler as described in connection with the chip composition (e.g., fatty acids or esters, alcohols or ethers thereof). The structurant may also be polyalkylene glycol with molecular weight between 2,000 and 20,000, preferably 3000 and 10,000. Such PEGs are commercially available, such as those marketed under tradename PEG 8000® or PEG 4000® from Union Carbide.

Other ingredients that can be used as structurants or fillers include starches, preferably water soluble starches such as maltodextrin and polyethylene wax or paraffin wax.

Structuring aids can also be selected from water soluble polymers chemically modified with hydrophobic moiety or moieties, for example, EO-PO block copolymer, hydrophobically modified PEGs such as POE(200-glyceryl-stearate, glucam DOE 120 (PEG Methyl Glucose Dioleate), and Hodg CSA-102 (PEG-150 stearate), and Rewoderm® (PEG modified glyceryl cocoate, palmate or tallowate) from Rewo Chemicals.

Other structuring aids which may be used include Amerchol Polymer HM 1500 (Nonoxynyl Hydroethyl Cellulose).

Finally, bars of the invention may comprise 0% to 25%, preferably 2% to 15% by wt. of an emollient such as ethylene glycol, propylene glycol and/or glycerine. Small amounts of these emollients can be added to base bar to modify lather attributes, skin feel etc.

Processing

In general, the additive, benefit agent chips are formed by mixing the ingredients in a mixer at a temperature just above the melting point of the polyalkylene glycol (e.g., about 50° C. and above, generally no higher than about 110° C.) for about 1 to 60 minutes, and then cooling in a chill roll. Order of addition is not critical. The "non" benefit agent chips are formed by similarly mixing and cooling (If used in one mixer, same ranges and temperatures are used).

The chips are than combined, for example, in a hopper or ribbon mixer where they may be refined (e.g., worked into a more pliable mass), plodded into billets, stamped and cut.

In a fourth embodiment of the invention, the invention relates to a method of forming additives (chips) containing a benefit agent which method comprises:

(a) mixing carrier, benefit agent, thickener, optional water and optional fatty acid in a container for 1 to 60 minutes at about above 50° C.; and (b) cooling the mixture on a chill roll to about 0 to 25° C. to form chips.

The following examples are intended to further illustrate the invention and are not intended to limit the invention in any way.

Unless stated otherwise, all percentages are intended to be percentages by weight.

EXAMPLES

Protocol

Silicone measurement was conducted as follows:

Analysis is done by method known as ICP (Inductively Coupled Argon Plasma). This procedure required a step involving extraction with xylene, and is therefore currently used only in-vitro. The ICP technique employed a Thermo Jarrell Ash Atom Scan 25 with measurements being made at 251.612 nm. Additional ICP measurement parameters are given below.

The treatment process was as follows:

The porcine skin was shaved, dermatomed, and sectioned into 25 cm pieces prior to treatment. The skin sample was then treated by rubbing the bar sample across the skin 10 times, in a back and forth motion. The resulting liquor on the skin was lathered for 30 seconds and then rinsed for 10 seconds with water which was regulated at 90–95° F. The treated skin sample was placed in a borosilicate scintillation vial that contained 10 ml of xylene. The samples were placed on a platform shaker for 1 hour to allow for the extraction of the silicone. After the extraction period, the skin was removed from the vial and the extract was analyzed using ICP technique. Sample solutions were tested against a 10 pm silicone standard.

What is measured is deposition of silicone (or other emollient) in parts per million.

Typical ICP Measurement Parameters for Measuring Silicone in Xylene

| | |
|---|---|
| Torch gas flow | high |
| Auxiliary gas flow | 1.5 L/min |
| Analyzer pump rate | 0.9 m L/min |
| Nebulizer pressure | 21 psi |
| Observation height | 12 mm above load cell |
| Plasma power | 1750 W |
| Wavelength | 251.612 nm |

-continued

Typical ICP Measurement Parameters for Measuring Silicone in Xylene

| | |
|---|---|
| Slit height | 6 mm |
| Integration time | 4 sec |

Example 1

Using the protocol discussed above, benefit agent deposition (e.g., deposition of silicone) was measured in compositions representing (1) the bar of Visscher et al. with no fumed silica chips; (2) the bars of the invention which did contain fumed silica chips; and (3) a liquid body wash composition. Each is discussed in greater detail below:

(1) Visscher Bar (WO 92/08444)

The Visscher bar was obtained following the procedure taken from WO 92/08444 (equivalent to U.S. Pat. No. 5,154,849) where polyethylene glycol is used as a carrier for silicone in bars (procedure was done in a Patterson mixture). Procedure was as follows:

(a) 681 gm of Carbowax PEG 8000 was melted and held around 60° C.;

(b) 400 gm of GE 350 cps silicone was added; and (c) 273 gm of GE 500,000 cps silicone was added.

(The patent explains the carrier to be 10:9 silicone A:PEG where silicone A is a blend of 40:60 silicone gum, 500,000 cps to silicone fluid, 350 cps)

The mixture remained in the mixer for 45 minutes until it was considered homogenous. The mixture was then removed and placed on a chill roll set at 7° C. The resulting "chips" were soft, pliable and severely tacky. Silicone covered the entire surface of the equipment.

A sample bar was prepared by chip mixing surfactant chip: Visscher chip ratio of 4:1 (wherein surfactant chip comprises 40–60% fatty acid isethionate, 20–30% fatty acid, 1–10% sodium isethionate, 1–10% sulfosuccinate, about 5% betaine, preservatives, dyes and minors); and extruding into a billet with a Weber Selander plodder. The resulting billet was soft and from experience not considered a viable product. The pressed bar lathered poorly. From experience this type of "chip" cannot be produced using conventional equipment.

More specifically, mixing surfactant chips and Visscher chips at a weight ratio of 4:1, respectively, resulted in large, non-free flowing clumps which adhered together by surface silicone. This result impeded feeding into the extruder. Material which did feed was extruded as a soft, sticky billet. When stamped, the bar had a poor surface, was tacky and produced little lather when wetted.

(2) Bar of the Invention

The bar of the invention comprised a 70%/30% mixture of chips wherein the 30% additive chip component had the following formulation range:

40–100%, preferably 40–80% polyethyleneglycol (e.g. PEG 8000);

10–50%, preferably 10–40% polydimethyl siloxane of 60,000 centistokes;

0.1 to 10%, preferably 1 to 5% Cab-o-sil® fumed silica (e.g., fumed silica 45-5);

0–20%, preferably 1–10% deionized water; and

0–20%, preferably 0–10% to $C_8$ to $C_{22}$ fatty acid and the 70% surfactant chips were like the surfactant chips used in the Visscher et al. bar, as follows:

about 40–60% by wt. fatty acid isethionate;

about 20–30% by wt. fatty acid;
about 1–10% by wt. sodium isethionate
about 1–10% by wt. sulfosuccinate;
about 5% by wt. betaine; and
remainder preservative, dyes, water and other minors.

A preferred benefit agent chip comprises as follows:

(a) 55–65% PEG (b) 2540% silicone (c) 1–7% fumed silica; and (d) 0–8% deionized water.

The chips were mixed, plodded together at the above-identified ratios, and extruded into bars.

(3) Liquid Body Wash

The liquid body wash had the following formulation:

| | % by wt. |
|---|---|
| Betaine | 5–15% |
| Sodium Cocoyl Isethionate | 1–10% |
| Anionic | 1–5% |
| Fragrance, preservatives | 0.1–2.0% |
| Water | to balance |

As noted deposition results were taken using the ICP techniques discussed and results set forth as follows:

| | Deposition. |
|---|---|
| Visscher Bar | 2.16 +/– 0.48 $\mu g/cm^2$ |
| Bar of Invention | 2.24 +/– 0.83 $\mu g/cm^2$ |
| Liquid | 2.14 +/– 0.62 $\mu g/cm^2$ |

It is surprising that the bar can deposit as well as the liquids. Moreover, in contrast to Visscher, the bar of the invention was readily processable and did not clog machinery (See Example 2).

Example 2

To further show differences between the bar of the invention and bars of Visscher, applicants decided to analyze the chips more closely.

Chips used in formation of the Visscher et al. bar, and chips carrying benefit agent and used in the formation of the bars of the invention were micrographed.

The Visscher et al. (P&G) chips show large "blobs" of silicone surrounding the alkylene glycol while the chips of the invention showed small discrete droplets of silicone.

While not wishing to be bound by theory, it is believed the difference in amount of silicone and how it is formed accounts for the tremendous processing difficulties experienced in forming the P&G bars relative to those of the invention. As noted above, 4:1 ratio of Visscher chips to surfactant chips formed large non-free flowing clumps which hindered chip feeding into the extruder and noodle processing. The clumps also caused agglomeration in the vacuum chamber which significantly reduced billet formation. Further, as noted, material which did extrude was soft and sticky and, when stamped, the bar had a poor surface, was tacky and produced little lather when wetted.

Example 3

A chip composition having the following composition was prepared:

| | |
|---|---|
| 852 g PEG 8000 (polyethylene glycol w/ MW of about 8000) | 46.3% |
| 426 g EO—PO copolymer* | 23.2% |
| 526 g maleated soybean oil | 28.6% |
| 35 g fumed silica | 1.9% |

*Pluronic F108: $(EO)_{128}(PO)_{54}(EO)_{128}$

The composition was prepared as follows:

PEG 8000 and EO-PO were melted up in overhead mixer and were allowed to deaerate. Maleated soybean oil and fumed silica were stirred in. After 2 minutes dispersion, the mixture was poured onto chill roll and collected as solid flakes. Melt temperature was 185° F.

This example shows both mixtures of EO-PO copolymer and polyalkylene (helping fine-tune dissolution of chips to similar of that of surfactant chips); and also shows use of maleated soybean oil.

Example 4

A chip composition having the following composition was prepared:

| | |
|---|---|
| 1000 g PEG 8000 | 51.3% |
| 500 g EO—PO copolymer* | 25.6% |
| 320 g petrolatum | 16.4% |
| 91 g sunflower seed oil | 4.7% |
| 38 g fumed silica | 2.0% |

*Pluronic F108: $(EO)_{128}(PO)_{54}(EO)_{128}$

The composition was prepared as follows:

Petrolatum was premixed with sunflower oil to make it liquid. PEG 8000 and EO-PO were melted up in overhead mixer and allowed to deaerate. Petrolatum/sunflower oil mixture was stirred in, followed by fumed silica. The mixture was poured onto chill roll. Melt temperature was 183° F.

Example 5

A chip composition having the following composition was prepared:

| | |
|---|---|
| 1000 g PEG 8000 | 49.0% |
| hydrophobically modified PEG* | 24.5% |
| 250 g petrolatum | 12.2% |
| 250 g PDMS, 100,000 cSt | 12.2% |
| 40 g fumed silica | 2.0% |

*POE (200) glyceryl stearate

The composition was prepared as follows:

PEG 8000 and hydrophobically modified were melted in overhead mixer. Petrolatum, PDMS, and fumed silica were added. The mixture was poured onto chill roll.

This example shows mixture of hydrophobically modified polyalkylene glycol and alkylene glycol as well as petrolatum as benefit agent.

Example 6

A chip composition having the following composition was prepared:

| | |
|---|---|
| 1000 g PEG 8000 | 45.3% |
| 500 g EO—PO copolymer* | 22.7% |
| 662 g PDMS, 100,000 cSt | 30.0% |
| 44 g fumed silica | 1.8% |

*Pluronic F108: $(EO)_{128}(PO)_{54}(EO)_{128}$

Chips were prepared as in Examples 3–5.

Example 7

1000 g of each of the chips of Examples 3–6 (representing 34% w/w of final bar) were combined with 1941 g of Dove® as surfactant chips (representing 66% w/w of final bar) in a ribbon blender and extruded into bars in a standard manner. The Dove® surfactant chips had composition as follows:

about 40–60% by wt. fatty acid isethionate;

about 20–30% by wt. fatty acid;

about 1–10% by wt. sodium isethionate about 1–10% by wt. sulfosuccinate;

about 5% by wt. betaine; and remainder preservative, dyes, water and other minors Throughput rate was as good as using chips of Dove® alone. Further, the rheological properties were comparable to that of Dove®. These experiments showed that the emollient containing chips could be successfully incorporated into bars without affecting processing and thus the emollient can be subsequently successfully delivered. As noted, a broad range of emollient oils can be delivered.

We claim:

1. An extruded toilet bar composition comprising 5–50% by wt. first chip composition comprising:

(a) 40% to about 80% by wt. of chip composition of a carrier selected from the group consisting of:

(1) hydrophobically modified polyalkylene glycol having molecular weight of about 4000–25,000, wherein the compound has formula $$(AG)_m—R \text{ or } R—(AG)_m—R,$$

wherein AG is alkylene glycol monomer unit, m>50 and R is a hydrophobic group which is a linear or branched alkyl, aryl, alkylaryl, alkylene or acyl having 4 to 60 carbon atoms, or a derivative of fats and oils;

(2) polyoxyethylene-polyoxypropylene copolymer having molecular weight about 4000 to 25,000;

(3) mixtures of (1) and (2); and (4) mixture of (1) and/or (2) with polyalkylene glycol having molecular weight greater than 4000 to 20,000;

(b) 10% to 40% by wt. of said chip composition of a benefit agent;

(c) 0.01 to 10% by wt. of said chip composition of a thickener;

(d) 0 to 10% by wt. of said chip composition of water; and (e) 0% to 15% by wt. of said chip composition of a structuring aid/filler selected from the group consisting of $C_8$ to $C_{24}$ fatty acids or ester derivatives, and $C_8$ to $C_{24}$ alcohols or ether derivatives;

and 80–60% by wt. second chips comprising 5 to 95% by wt. of a surfactant system wherein the surfactant is selected from the group consisting of soap, anionic surfactant, nonionic surfactant, amphoteric surfactant, cationic surfactant and mixtures thereof;

wherein said bar is made by:

(i) mixing ingredients (a) to (e) of said first chip composition at a temperature above about 50° C. for about 1 to 60 minutes wherein the thickening agent thickens the carrier to provide a viscosity equal to or greater than 800 cps;

(ii) cooling said ingredients of (i) to form chips;

(iii) separately mixing ingredients of the second chips with surfactant system at about the same temperature and time range as in (i);

(iv) cooling said ingredients of (iii) to form chips;

(v) combining chips formed from (ii) and (iv) in a mixer or hopper;

(vi) optionally refining the mixed chips;

(vii) plodding said mixed chips into billets;

(viii) stamping and cutting said billets into bars.

2. A composition according to claim 1, wherein the surfactant system comprises (a) a first anionic surfactant; and (b) a second surfactant selected from the group consisting of a second anionic different from the first, a nonionic, an amphoteric and mixtures thereof.

3. A composition according to claim 2, wherein the first anionic surfactant is acyl isethionate.

4. A composition according to claim 3, wherein the isethionate is present from 10% to 70% by weight of the final bar composition.

5. A composition according to claim 2, wherein the second surfactant is sulfosuccinate.

6. A composition according to claim 2, wherein the second surfactant is betaine.

7. A composition according to claim 6, wherein the betaine is amidococoylbetaine.

8. A composition according to claim 2, wherein the second surfactant comprises a mixture of sulfosuccinate and betaine.

9. A composition according to claim 2, wherein the benefit agent is silicone.

10. A composition according to claim 2, wherein the benefit agent is petrolatum.

11. A composition according to claim 2, wherein the benefit agent is maleated soybean oil.

12. A composition according to claim 2, wherein the benefit agent is sunflower seed oil.

13. A composition according to claim 2, wherein the thickener is fumed silica.

14. A composition according to claim 2, wherein the thickener is water soluble starch.

* * * * *